US007661381B2

(12) United States Patent
Gorelik et al.

(10) Patent No.: US 7,661,381 B2
(45) Date of Patent: Feb. 16, 2010

(54) SELF-RIGHTING POOL CLEANING ROBOT

(75) Inventors: Boris Gorelik, Kiryat-Ata (IL); Tzachi Shpitzer, Haifa (IL); Amir Yakobovitch, Haifa (IL)

(73) Assignee: Aquatron Robotic Systems Ltd., Afula Illit (IL)

( * ) Notice: Subject to any disclaimer, the term of this patent is extended or adjusted under 35 U.S.C. 154(b) by 161 days.

(21) Appl. No.: 11/936,423

(22) Filed: Nov. 7, 2007

(65) Prior Publication Data

US 2008/0105188 A1 May 8, 2008

Related U.S. Application Data

(60) Provisional application No. 60/857,733, filed on Nov. 7, 2006.

(51) Int. Cl.
*B63B 59/00* (2006.01)

(52) U.S. Cl. ..... 114/222; 114/121

(58) Field of Classification Search ..... 114/222, 114/121, 124, 330; 15/1.7; 210/780
See application file for complete search history.

(56) References Cited

U.S. PATENT DOCUMENTS 3,695,203 A * 10/1972 Helbig ..... 114/50
4,697,536 A * 10/1987 Hirata ..... 114/222
5,351,355 A 10/1994 Chiniara et al.
6,115,864 A 9/2000 Davidsson et al.
6,409,916 B1 6/2002 Zelas et al.
6,473,927 B1 11/2002 Sommer et al.
2008/0099409 A1 5/2008 Gorelik et al.
2008/0105188 A1 5/2008 Gorelik et al.

OTHER PUBLICATIONS

U.S. Appl. No. 11/588,510, filed on Oct. 26, 2006.
U.S. Appl. No. 60/857,733, filed on Nov. 7, 2006.

* cited by examiner

*Primary Examiner*—Ed Swinehart
(74) *Attorney, Agent, or Firm*—Darby & Darby P.C.

(57) ABSTRACT

A vehicle includes a submersible housing and a propulsion mechanism, which is coupled to drive the housing over an interior surface of a container in which the housing is submerged. A hollow tube is fixed to the housing and is configured to be filled with a fluid having a first specific gravity. One or more objects, which have a second specific gravity that is less than the first specific gravity, are contained within and capable of moving inside the hollow tube so as to stabilize the housing in response to changes of an angle of the interior surface over which the vehicle travels.

5 Claims, 3 Drawing Sheets

SELF-RIGHTING POOL CLEANING ROBOT

CROSS-REFERENCE TO RELATED APPLICATION

This application claims the benefit of U.S. Provisional Patent Application 60/857,733, filed Nov. 7, 2006.

FIELD OF THE INVENTION

The present invention relates generally to underwater cleaning devices, and specifically to devices for cleaning the inner surfaces of a swimming pool or other liquid container.

BACKGROUND OF THE INVENTION

A variety of submersible devices are known in the art for automated cleaning of swimming pools. Some of these devices comprise wheels or treads with an internal propulsion system, so that the device travels autonomously along the floor (and sometimes the walls) of the swimming pool. Devices of this sort are referred to commonly as "robots." While the robot travels through pool, it sucks contaminants from the floor (and walls) through ports in the lower surface of the robot into an internal filter element.

SUMMARY OF THE INVENTION

The inner surfaces of swimming pools and other liquid containers are often tilted and may include vertical sides. To clean such surfaces effectively, it is necessary to ensure that the cleaning ports of the robot (typically on the lower side of the robot) remain close to the surface over which it is traveling and that the robot does not tip over on angled surfaces, which may be tilted or even vertical. Similar problems may arise in motion of submersible vehicles of other types.

Embodiments of the present invention that are described hereinbelow provide a novel mechanism and method for ensuring that a submerged vehicle maintains the proper attitude relative to the surface along which the vehicle is traveling. In some embodiments, the vehicle comprises a hollow tube, which is filled with fluid. The tube contains one or more objects that have a specific gravity less than that of the fluid and are capable of moving within the tube. Changes in the attitude of the vehicle cause the objects to shift in the tube, thereby shifting the center of buoyancy of the vehicle in a manner that ensures that the vehicle maintains contact with the surface and does not tip over regardless of the angle of the surface.

There is therefore provided, in accordance with an embodiment of the present invention, a vehicle, including:

a submersible housing;

a propulsion mechanism, which is coupled to drive the housing over an interior surface of a container in which the housing is submerged;

a hollow tube, which is fixed to the housing and is configured to be filled with a fluid having a first specific gravity; and one or more objects, which have a second specific gravity that is less than the first specific gravity and which are contained within and capable of moving inside the hollow tube so as to stabilize the housing in response to changes of an angle of the interior surface over which the vehicle travels.

In a disclosed embodiment, the housing has ingress and egress ports, and the vehicle includes an impeller, which is disposed within the housing so as to draw water into the housing through the ingress port and to expel the water through the egress port, and a filter, which is contained within the housing and configured to communicate with the ingress and egress ports so as to trap contaminants in the water as the water passes through the housing. Typically, the housing has a lower side that contains the ingress port, and the hollow tube and the one or more objects contained within the tube are configured to maintain the lower side of the housing in a position adjacent to the interior surface of the container.

The hollow tube may be configured to serve as a handle for lifting the vehicle. In a disclosed embodiment, the hollow tube has one or more openings, which are configured to permit the fluid to flow into the hollow tube when the vehicle is submerged in the fluid, and to drain out of the hollow tube when the vehicle is removed from the fluid. The one or more objects may include at least one ball.

In one embodiment, the hollow tube includes a curved segment and is configured so that the one or more objects congregate at a center of the curved segment while the vehicle travels over a horizontal part of the interior surface and move to an end of the curved segment when the vehicle travels on a tilted part of the interior surface.

Typically, the housing has a lower side that is located adjacent to the interior surface while the vehicle travels over the interior surface, and the housing and the hollow tube are configured so that a center of gravity of the vehicle is closer to the lower side of the housing than is a center of buoyancy of the vehicle. Movement of the one or more objects in the hollow tube causes a shift in a location of the center of buoyancy relative to the center of gravity.

There is also provided, in accordance with an embodiment of the present invention, a method for stabilizing a submersible vehicle, the method including:

fixing a hollow tube to a housing of the vehicle, wherein the hollow tube is configured to be filled with a fluid having a first specific gravity;

inserting in the hollow tube one or more objects, which have a second specific gravity that is less than the first specific gravity, so that the one or more objects are capable of moving inside the hollow tube so as to stabilize the housing in response to changes of an angle of an interior surface of a container in which the vehicle is submerged as the vehicle travels over the interior surface.

The present invention will be more fully understood from the following detailed description of the embodiments thereof, taken together with the drawings in which:

DETAILED DESCRIPTION OF EMBODIMENTS

Figure 1:
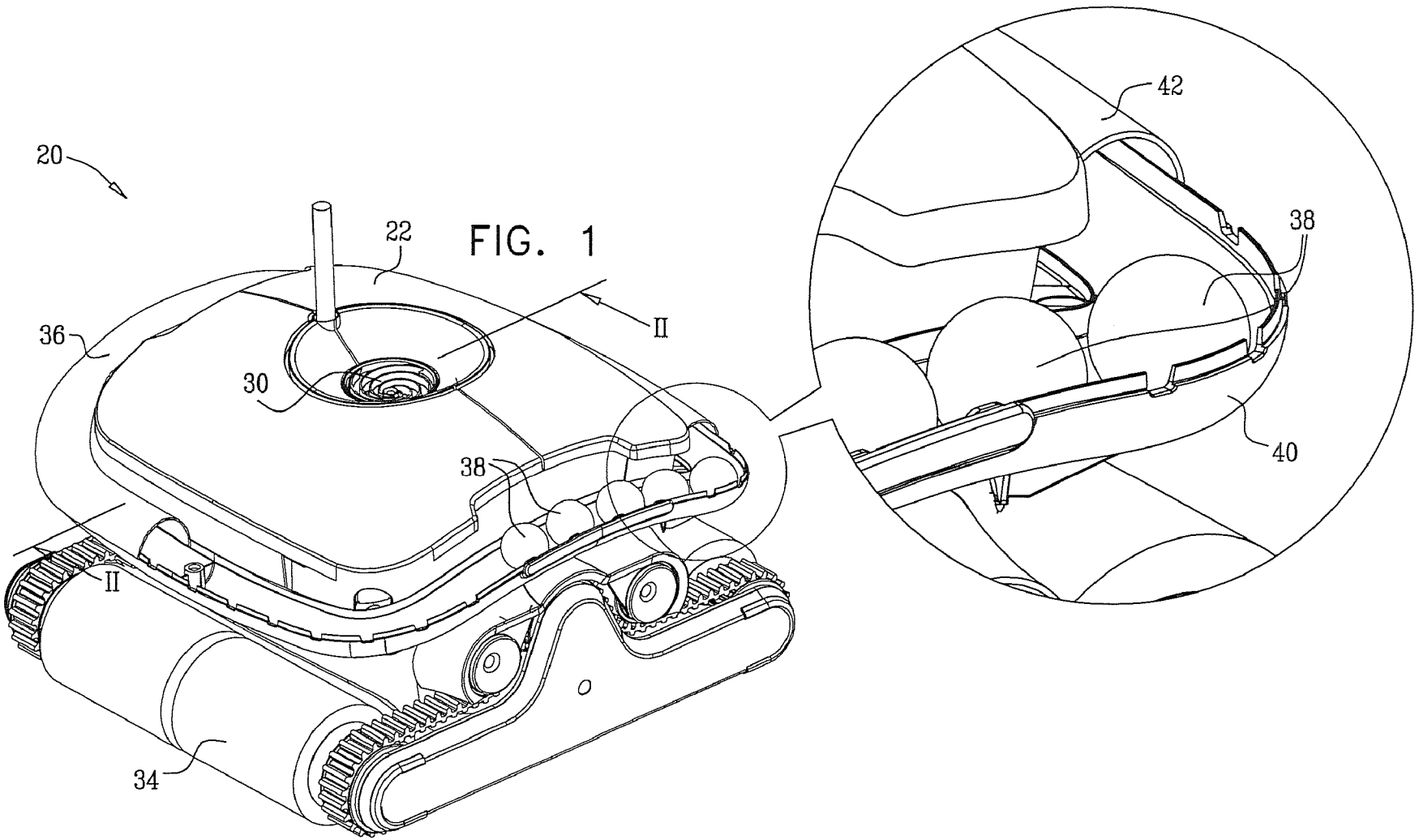
FIG. 1 is a schematic, pictorial, partly cutaway illustration of a robot for cleaning a swimming pool, in accordance with an embodiment of the present invention.
Figure 2:
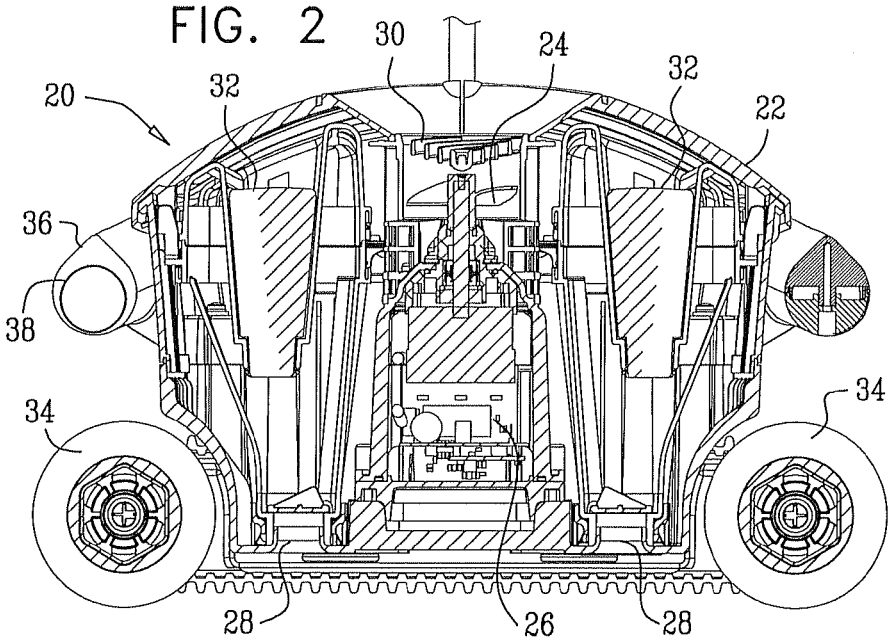
FIG. 2 is a schematic sectional view of the robot of FIG. 1.
Figure 3:
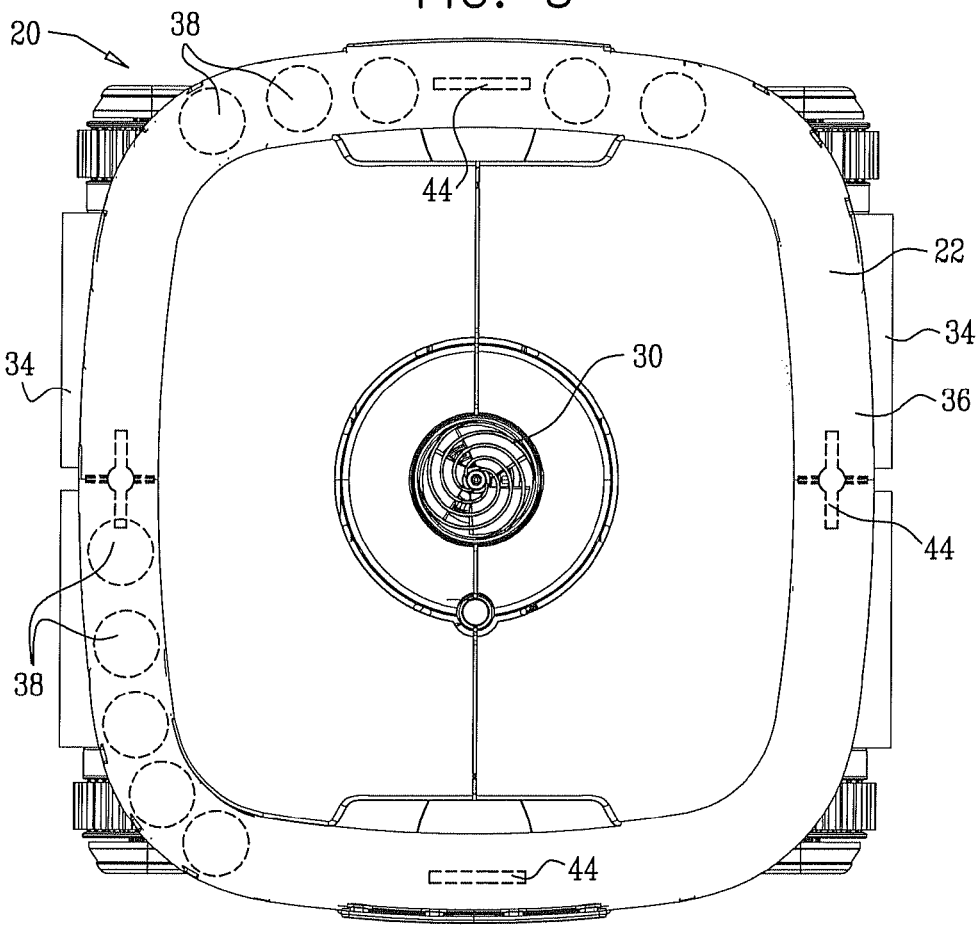
FIG. 3 is a schematic top view of the robot of FIG. 1.

Reference is now made to FIGS. 1-3, which schematically illustrate a robot 20, which is a submersible vehicle for cleaning the interior of a swimming pool or other fluid container, in accordance with an embodiment of the present invention. FIG. 1 is a schematic, pictorial, partly cutaway view of the robot. FIG. 2 is a sectional view, taken along a line II-II in FIG. 1. FIG. 3 is a top view.

Robot 20 comprises a housing 22, which contains an impeller 24 driven by a motor 26. The impeller draws water into housing 22 through ingress ports 28 on the lower side of the housing, which is normally adjacent to the surface being cleaned. The water passes from the ingress ports into filters 32 inside the housing, and then out through an egress port 30 on the upper side of the robot. Contaminants in the water are thus trapped inside the filters. The filters comprise a suitable, flexible filter material, such as a dense-weave cloth or porous synthetic.

A propulsion motor (not shown) drives wheels 34 to propel the robot along the inner surface of the pool. The motor and wheels, along with the associated drive train, thus constitute the propulsion mechanism of the robot. Alternatively, other sorts of propulsion mechanisms, as are known in the art, may be used to drive the robot.

The internal construction and operation of robot 20 are similar to those of a robot described in U.S. patent application Ser. No. 11/588,510, filed Oct. 26, 2006, which is assigned to the assignee of the present patent application and whose disclosure is incorporated herein by reference. This particular design of the robot (in which housing 22 opens upward to provide access to filters 32) is shown merely by way of illustration, and not limitation. The principles of the present invention are similarly applicable, mutatis mutandis, to other robot designs, as well as to submersible vehicles of other types. Furthermore, although the embodiments described herein refer specifically to cleaning of swimming pools, the principles of the present invention may likewise be applied in vehicles for cleaning the inner surfaces of containers holding other sorts of fluids.

A hollow tube 36 is fixed around housing 22. This tube is configured to serve as a handle for lifting and carrying robot 20. In addition, tube 36 serves as a self-righting mechanism, for ensuring that the robot maintains the desired attitude with respect to the inner surface of the pool over which the robot travels, with ports 28 in close proximity to the inner surface of the pool regardless of the angle of the surface. Details of this mechanism are described hereinbelow. Although tube 36 may conveniently be made to surround the entire housing of the robot, the principles of this self-righting mechanism may be implemented using one or more tubes that extend around, along, or within only a part of the housing, as will be apparent to those skilled in the art. Furthermore, although tube 36 is shown as having a certain shape and a profile that is approximately circular, the principles of the self-righting mechanism that are described hereinbelow may be realized using tubes of other types and shapes. All such variations are considered to be within the scope of the present invention.

In operation of robot 20, tube 36 is filled with a fluid and contains objects, such as balls 38, that are made of a material having a smaller specific gravity than the fluid. For example, assuming the fluid in the tube is water, balls 38 may comprise a light-weight plastic, such as polystyrene foam. The balls have a smaller diameter than the inner diameter of the tube and are thus capable of moving within the tube. In the illustrated embodiment, as shown in FIG. 1, tube 36 comprises a lower half-tube 40 and an upper half-tube 42, which are fitted together to contain balls 38. A portion of upper half-tube 42 is cut away in FIG. 1 to show the balls inside the tube. Alternatively, the objects inside the tube may have a different shape, so long as the shape and size of the objects are suitable to permit the desired movement within the tube.

The fluid in tube 36 may conveniently be the fluid, such as water, in which the robot is immersed, and the tube may have openings through which the water may fill the tube during immersion and drain out of the tube when the robot is removed from the water. Thus, as shown in FIG. 3, tube 36 may have one or more slots 44 in its lower surface through which water may flow into and out of the tube, as well as one or more slots 44 in its upper surface through which air may escape while the tube fills with water and may flow back into the tube as the water drains out. Additional slots may be provided on the sides of the tube.

Figure 4A:
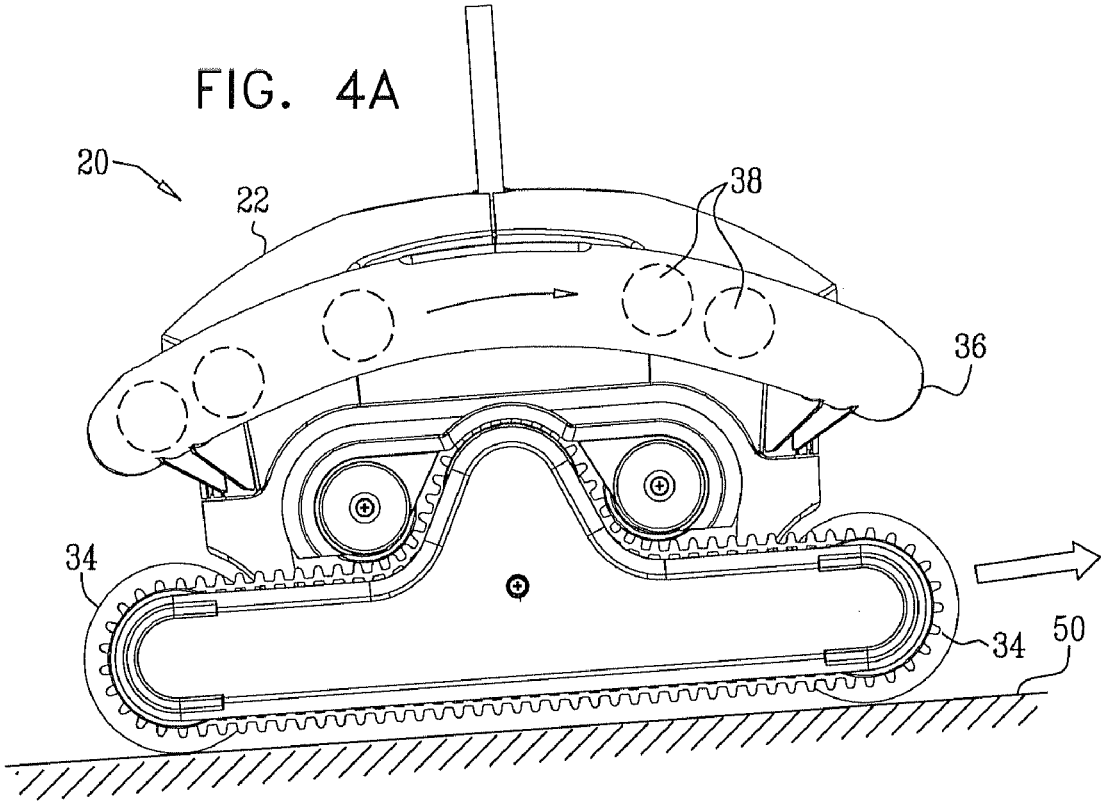
FIGS. 4A and 4B are schematic side views of the robot of FIG. 1, illustrating motion of the robot over tilted surfaces in accordance with an embodiment of the present invention.
Figure 4B:
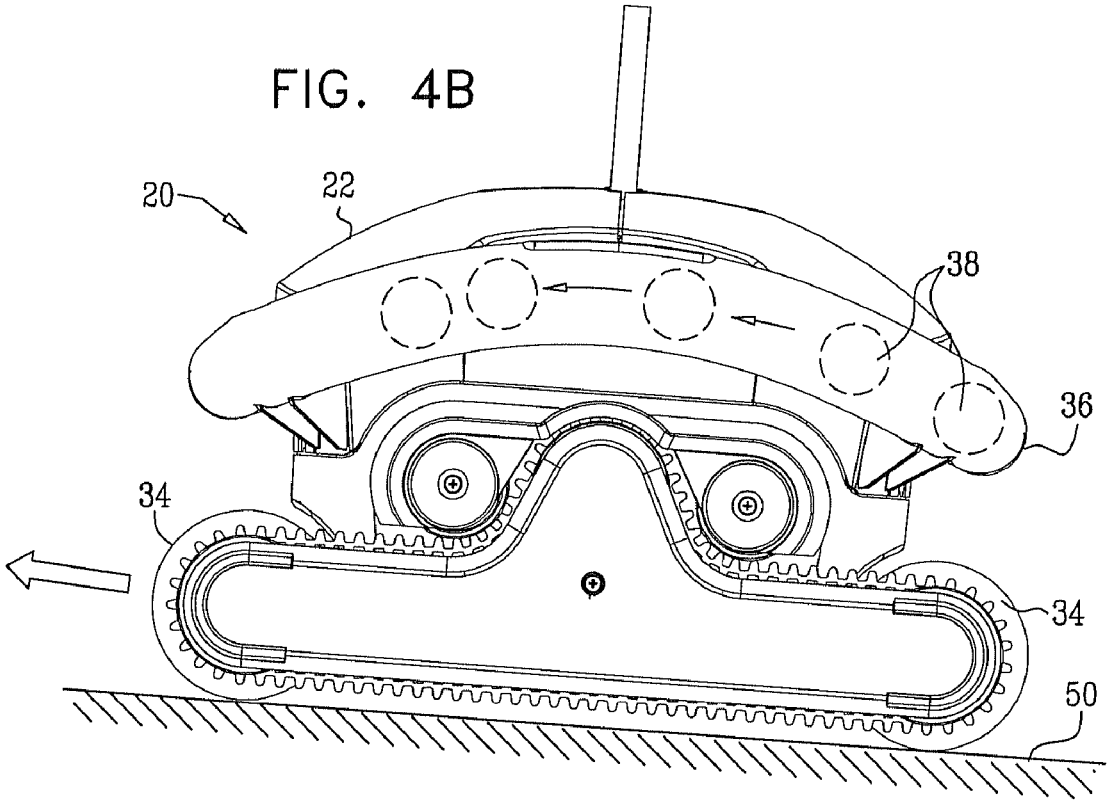

FIGS. 4A and 4B are schematic side views of robot 20, illustrating motion of the robot over tilted surfaces 50 and 52, respectively, in accordance with an embodiment of the present invention. It can be seen in these figures that tube 36 includes curved segments, with the highest part of the curve above the center of the robot at either side and the lower part of the curve at the front and rear ends of the robot. (Since motion of the robot is typically bidirectional, the terms "front" and "rear" are used solely for the sake of convenience to denote the parts of the robot that may, at any given time, be adjacent to or opposite to the direction of motion.)

As a result of this curved shape, when robot 20 is immersed in the pool and sinks to a horizontal surface, the relative buoyancy of balls 38 causes the balls to rise and congregate in tube 36 around the elevated center point. In this position, the center of buoyancy of the robot, which is near the geometrical center of housing 22, is directly above the center of gravity of the robot, which is typically in the vicinity of motor 26 (FIG. 2).

When the robot begins traveling up a tilted surface, however, as in FIG. 4A or 4B, the buoyancy of balls 38 causes the balls to move within tube 36 to the higher end of the robot, while displacing the water in the tube to the lower end. Consequently, the center of buoyancy also shifts toward the upper end of the robot, although still remaining higher than the center of gravity. Thus, in FIG. 4A the center of buoyancy shifts to the right, whereas the center of buoyancy shifts to the left in FIG. 4B. The shift of the center of buoyancy causes the robot to orient itself stably in the proper attitude, with both of wheels 34 in contact with the surface of the pool and inlet ports 28 adjacent to the surface, regardless of the tilt angle of the surface. Because of the relative positions of the center of buoyancy and the center of flotation, the robot will maintain this attitude and will not tip over backward even while wheels 34 climb a vertical surface, such as the side of the pool.

The action of buoyant balls 38 in tube 36 is particularly effective in keeping robot 20 in the proper attitude when climbing a vertical surface, such as the side of a swimming pool. The force exerted by impeller 24 presses wheels 34 against the side of the pool. Meanwhile, balls 38 move to the upper side of tube 36, causing the center of buoyancy of the robot to shift upward, to a location higher than the center of mass, so as to counteract the tendency of the robot to tip over backward, away from the wall. Should the robot begin to tip, balls 38 will shift toward the highest point in the upper side of tube 36, thus creating a sort of "negative feedback" that will drive the upper wheel of the robot back toward the wall.

Although the embodiment described above refers to a robot for the specific purpose of cleaning a swimming pool, the principles of the present invention may similarly be applied to submersible vehicles of other types. It will thus be appreciated that the embodiments described above are cited by way of example, and that the present invention is not limited to what has been particularly shown and described hereinabove. Rather, the scope of the present invention includes both combinations and subcombinations of the various features described hereinabove, as well as variations and modifications thereof which would occur to persons skilled in the art upon reading the foregoing description and which are not disclosed in the prior art.

The invention claimed is:

1. A vehicle, comprising:

a submersible housing, having ingress and egress ports;

an impeller, which is disposed within the housing so as to draw water into the housing through the ingress port and to expel the water through the egress port;

a filter, which is contained within the housing and configured to communicate with the ingress and egress ports so as to trap contaminants in the water as the water passes through the housing;

a propulsion mechanism, which is coupled to drive the housing over an interior surface of a container in which the housing is submerged;

a hollow tube, which is fixed to the housing and is configured to be filled with a fluid having a first specific gravity; and one or more objects, which have a second specific gravity that is less than the first specific gravity and which are contained within and capable of moving inside the hollow tube so as to maintain a constant attitude of the vehicle relative to the interior surface along which the vehicle travels.

2. The vehicle according to claim 1, wherein the hollow tube is configured to serve as a handle for lifting the vehicle.

3. The vehicle according to claim 1, wherein the hollow tube has one or more openings, which are configured to permit the fluid to flow into the hollow tube when the vehicle is submerged in the fluid, and to drain out of the hollow tube when the vehicle is removed from the fluid.

4. The vehicle according to claim 1, wherein the one or more objects comprise at least one ball.

5. The vehicle according to claim 1, wherein the hollow tube comprises a curved segment and is configured so that the one or more objects congregate at a center of the curved segment while the vehicle travels over a horizontal part of the interior surface and move to an end of the curved segment when the vehicle travels on a tilted part of the interior surface.

* * * * *